United States Patent [19]

Ashworth, III

[11] 4,398,318

[45] Aug. 16, 1983

[54] CARD CLOTHING FOR CARDING MACHINE ELEMENTS

[75] Inventor: Robert C. Ashworth, III, Greenville, S.C.

[73] Assignee: Ashworth Bros., Inc., Fall River, Mass.

[21] Appl. No.: 259,365

[22] Filed: Apr. 30, 1981

[51] Int. Cl.[3] ..... D01G 15/84

[52] U.S. Cl. ..... 19/114

[58] Field of Search ..... 19/114

[56] References Cited

U.S. PATENT DOCUMENTS

| | | | |
|---|---|---|---|
| 922,448 | 5/1909 | Bates et al. | 19/114 |
| 1,530,285 | 3/1925 | Allen | 19/114 |
| 1,630,158 | 5/1927 | Allen | 19/114 |
| 2,175,131 | 10/1939 | Schwartz | 19/114 |
| 2,731,676 | 1/1956 | Apthorp et al. | 19/114 |
| 2,937,413 | 5/1960 | Hollingsworth | 19/114 |
| 4,090,276 | 5/1978 | Roberts | 19/114 |
| 4,221,022 | 9/1980 | Iida | 19/114 X |

FOREIGN PATENT DOCUMENTS

| | | | |
|---|---|---|---|
| 1063497 | 8/1959 | Fed. Rep. of Germany | 19/114 |
| 572506 | 6/1924 | France | 19/114 |

*Primary Examiner*—Louis Rimrodt

*Attorney, Agent, or Firm*—Schuyler, Banner, Birch, McKie & Beckett

[57] ABSTRACT

Metallic wire card clothing for carding elements is provided by a plurality of wire strips disposed side-by-side, as by helically winding at least two strips abutting each other on a supporting roll element, with each strip having an upstanding portion providing a row of teeth extending along the strip and the front edges of the teeth on each strip defining a common acute angle with the axis of the strip on which they are carried. The common acute angle of the teeth in one row is greater than the common acute angle of the teeth in the adjacent row by more than 10 degrees with preferably this difference in angles being at least 20 degrees and the acute angles for the front edges of the teeth relative to the strip axis being in the range of approximately 40 degrees to 90 degrees.

6 Claims, 3 Drawing Figures

CARD CLOTHING FOR CARDING MACHINE ELEMENTS

BACKGROUND OF THE INVENTION

This invention relates generally to the art of carding fibers and particularly to card clothing for the carding elements used with conventional carding machines.

The art of fiber carding is highly developed and the techniques employed therein well known. A conventional carding machine may consist of a rotating carding cylinder and a plurality of flat bars, commonly called flats, which surround about one-third of the surface of the carding cylinder. The surfaces of the carding cylinder and the flats are usually toothed or provided with upstanding wires, pins or needles so that the interaction of the carding cylinder and the flats opens and combs the fibers, removing foreign matter therefrom. The result of the carding process is a clean, combed, uniformly dispersed sheet or web. There are other types of cards and garnets that employ or use workers and strippers instead of flats to perform the carding of the fibers.

The carding cylinder rotates, and typically the flats move also, in the same direction as the carding cylinder, but at quite different speeds. In this known environment, these carding cylinder and flats provide the carding elements.

Typically, both the carding cylinder and the carding flat comprise a base or support upon which card clothing is mounted. Carding cylinders have been covered with wrappings of toothed metallic wire wound helically around the cylinder, this wire providing radially projecting teeth forming the card clothing on the cylinder. It has been known to construct flats by covering the supporting element with short strips of rigid metallic wire oriented parallel to the direction of fiber flow across the carding surface, this wire having outwardly projecting teeth like the toothed metallic wire wound helically around a supporting carding cylinder.

The metallic wire card clothing used in conventional carding operations and placed upon conventional carding elements such as cylinders, lickerins, doffers, flats, workers, strippers, and the like, has teeth provided on the toothed metallic wire forming the carding surface on the supporting element. Commonly, these teeth are provided in a saw-toothed configuration. Where the teeth are provided by a toothed metallic wire would helically around a cylinder, the outwardly extending height of the teeth on the wire convolutions has usually provided a uniform height to the card clothing. However, the prior art has suggested card clothing wherein the teeth in one convolution on the carding cylinder are of one uniform height whereas the teeth on the adjacent convolution of the carding cylinder are of a different uniform height.

In the prior art, carding fibers has aimed at forming a clean combed uniformly dispersed sheet or web of the fibers. In this regard the formation and orientation of the teeth providing the card clothing on a carding machine element has generally been characterized by having uniformity or at least similarity between the multitude of teeth defining a card clothing area on the carding element. While not overlooking the advantages of the heretofor known and utilized techniques espoused in the prior art, it has been found that in certain circumstances there are advantages to be obtained by providing a particular orientation and sizing of the teeth forming the card clothing surface. In this regard, the prior art concepts and apparatuses for providing carding surfaces are not found to function with the desired perfection in all carding applications.

Indeed it has been found that the ideal achievement of perfect combing of the fibers to give a uniformly dispersed web coming from the carding operation is not always the desired result of the carding operation. In this regard, a disorienting and tangling of the fibers making up the web being carded can provide a uniformly disoriented web fiber content with consequent increase in the cross-directional strength of the web that is produced.

SUMMARY OF THE INVENTION

The invention hereinafter disclosed in detail achieves the objective mentioned immediately hereinabove by, in essence, disorienting and tangling the fibers making up the web incident the carding operation. However, the fibers are uniformly disoriented and with this uniformity of fiber intertangling the cross-directional strength of the web produced is increased.

Under the teachings of this invention, a carding surface is provided by a plurality of wire strips disposed side-by-side with each strip having an upstanding portion providing a row of teeth extending along the strip, the strips with the teeth thereon defining the card clothing. Where the carding element is to be provided by card clothing on a supporting roll or cylinder, the plurality of strips may easily be provided by helically winding at least two strips abutting each other on a supporting roll. Each strip will have a different toothed configuration with all teeth on each individual strip being similar as described hereinafter. Where two strips are helically wound it will be recognized that a double wound carding element is provided.

Under the concepts of this invention, each toothed strip, as between two strips helically wound on a supporting carding roll, has an upstanding portion providing a row of teeth extending along the strip. The front edges of the teeth on each strip define a common acute angle with the axis of the strip on which they are carried. When two or more of these toothed wire strips are disposed side-by-side, under the invention herein, the common acute angle of the teeth in one row is selected to be greater than the common acute angle of the teeth in the adjacent row.

The difference between the common acute angles of the teeth in the adjacent rows is to be more than 10 degrees and preferably at least 20 degrees. Further, the acute angles of the front edges of the teeth relative to the strip axis of each of the toothed wire strips may best fall in the range of approximately 40 degrees to 90 degrees.

Providing differing pitches, by more than 10 degrees, of the teeth in adjacent rows on the carding surface, has been found to offer distinct advantages. These may be most easily achieved by forming the carding cylinder surface by double winding toothed wire strips as mentioned above. The double winding may advantageously be employed on, for example, a doffer or condensing roll, or both. Where the tooth arrangement or configuration of this invention is used in a card doffer in operative relationship with a condensing roll the surface speeds between these rolls will normally be two-thirds to one-half of the surface speed of the doffer. By using a double wound doffer and/or compacting roll having the tooth configuration and relationship described above, a card web can be obtained with the fibers therein disoriented or more tangled than one with a single wound strand of toothed wire wherein all teeth are similarly configured or at the same pitch.

By using a double wound doffer with a single wound toothed wire compacting roll the toothed wire having the teeth with the heavy pitch or smaller acute angle relative to the axis of the toothed wire facilitates removal of the fibers from the carding cylinder by reason of this strong or heavy pitch. Conversely, the adjacent row of teeth having the greater acute angle relative to the toothed wire axis provide a slack pitch which resists the removal of the fibers from the doffer by the compacting roll, thus disorienting and tangling the fibers to make a web which is uniformly disoriented and thereby increasing the cross-directional strength of the web that is produced.

It is to be recognized that the concepts of this invention utilizing a double wound toothed strip with the teeth on adjacent rows of differing pitch can well be employed on a doffer, compacting, condensing roll such as to achieve the disorientation of the web fibers in a uniform manner. Broadly, the concepts of this invention may be used on any roll of a card or similar machine to control the fibers on the rolls. In addition, the concepts of this invention may be used in a metallic flat, plate or cover to control the fibers of a web being processed.

A number of objects and advantages of this invention, will become apparent from a study of the attached drawing and the description of a preferred embodiment set forth below.

DESCRIPTION OF A PREFERRED EMBODIMENT

Figure 1:
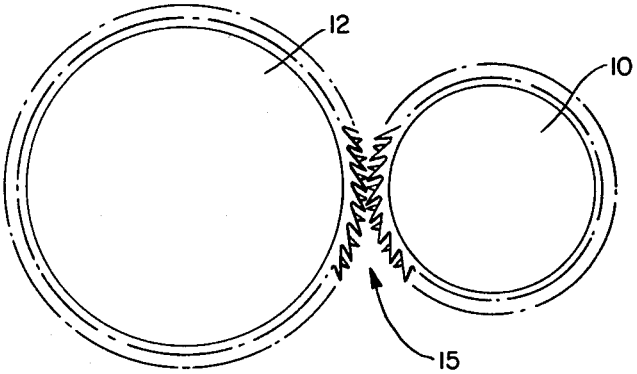
FIG. 1 is a diagrammatic view showing portions of two cylindrical carding elements arranged in a carding machine environment.

FIG. 1 diagrammatically illustrates the relationship that two carding elements in the form of rolls 10 and 12 have in a carding machine 15. As may be visualized from the simplified showing on FIG. 1, the card clothing on each of rolls 10 and 12 may be provided by toothed wire strips helically wound onto the supporting roll whereby the carding surface is provided by the outwardly projecting teeth encircling these carding roll elements.

Under the teachings of this invention, one or both of rolls 10 and 12 will have the card clothing formed thereon by helically winding at least two toothed wire strips such that the convolutions abut each other as between the two strips on the supporting roll. Also, as between adjacent strips, the row of teeth on each strip has a particular configuration and is particularly related to the different configuration of the teeth in the row carried by the adjacent strip.

Figure 2:
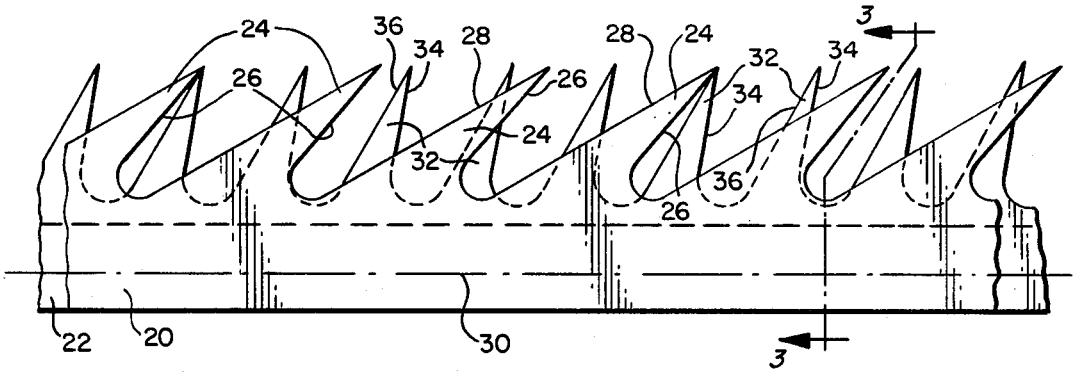
FIG. 2 is a side elevational view of a segment of two toothed wire strips disposed side-by-side having teeth configured in accordance with the invention.

For ease in illustrating the differing tooth configuration in adjacent rows forming the card clothing surface, a segment of two toothed wire strips disposed side-by-side is shown on FIG. 2 with the strip segments illustrated in a straight line relationship to each other. It may be noted that whereas the wire card clothing formed by helically winding at least two strips abutting each other on a supporting roll makes the adaptation of the invention ideally suited for doffers, compacting or isomizing rolls, and other double wound roll configurations for carding elements, the concepts are equally applicable to metallic flats, plates or covers wherein the side-by-side tooth wire strips would more generally assume a straight line condition as shown in FIG. 2.

More specific details may best be described with reference to FIGS. 2 and 3 on the drawing. As shown thereon, a pair of metallic wire strips 20 and 22 are disposed side-by-side. Visualizing extended lengths of these side-by-side strips helically wound such as to form card clothing on one or both of rolls 10 and 12 of carding machine 15, the base portion of these two strips would be abutting each other in adjacent convolutions. This type relationship between the base portions of the strips is shown in section on FIG. 3.

An upstanding portion on strip 20 provides a row of similarly contoured teeth 24 extending along the length of the strip. Each tooth 24 has a front edge 26 and a trailing edge 28. As clearly shown on the side view segment of wire strip 20 on FIG. 2, the front edge 26 and trailing edge 28 of each tooth 24 converge away from the base portion of strip 20 to define the point of the tooth with the points of teeth 24 disposed at the same height relative to the strip axis as represented by broken line 30 on FIG. 2.

Figure 3:
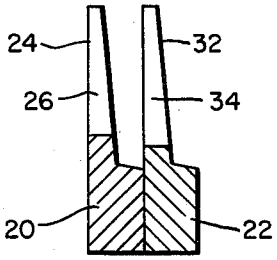
FIG. 3 is a sectional view taken on line 3—3 of FIG. 2.

Referring to toothed wire strip 22 as shown on FIGS. 2 and 3 of the drawing, it also has an upstanding portion carried by the base portion of strip 22 that provides a row of similarly contoured teeth 32. Each tooth 32 has a front edge 34 and a trailing edge 36. These edges converge away from the base portion of strip 22 to define each tooth 32 with the points of teeth 32 forming the row on strip 22 lying at the same height relative to the strip 22 axis represented by broken line 30 on FIG. 2.

Whereas the height of the two rows of adjacent teeth 24 and 32 carried by the wire strips 20 and 22 is shown to be the same on FIGS. 2 and 3 of the drawing, it is to be understood that this identity of height has between adjacent rows may not be necessary when the objectives to be obtained in the carded web of fibers are taken into consideration.

An important feature of the metallic wire card clothing formed by the teeth on a plurality of side-by-side wire strips resides in the particular configuration of the teeth 24 making up one row in comparison with the teeth 32 making up the adjacent row. Referring to the leading edges 26 of teeth 24 on wire strip 20, it will be seen that these front end tooth edges define an acute angle with the axis of strip 20 as may be identified by line 30 on FIG. 2. This may be referred to as the front angle or pitch of the teeth 24 on wire strip 20. In the embodiment illustrated on FIG. 2, this front angle is 50 degrees. The trailing edge 28 of each tooth 24 also defines an acute angle relative to the axis of strip 20 which may be considered to be represented by broken line 30 on FIG. 2. This may be referred to as the back angle and as shown on FIG. 2 such angle is 30 degrees. In the structure shown, the teeth 24 are similarly configured such that in the row of teeth 24 on strip 20 the front edges 26 define a common acute front angle with the axis of the strip or have a common pitch along the strip while the trailing edges 28 similarly define a common back angle with the axis of the strip 20.

By the same token, referring to the teeth 32 carried by the base portion of strip 22, it will be seen that the front edges 34 of teeth 32 define a common acute front angle with the base portion of strip 22 this angle being specifically illustrated on FIG. 2 as 80 degrees. The trailing edges 36 on teeth 32 of strip 22 also define a common acute back angle with the axis of strip 22 and this angle is illustrated on FIG. 2 as 60 degrees.

Having specifically described the contoured identity of the row of teeth 24 on strip 20 and similar identity between the contours of teeth 32 on strip 22 an important difference between the two adjacent rows of teeth lies in the different pitches existing between the separate teeth making up the two rows. It has been found that in gaining the advantages for the card clothing of this invention, the pitch of the teeth in one row should differ from the pitch of the teeth in the adjacent row by at least 10 degrees. In the illustrated embodiment, the pitch difference shown amounts to 30 degrees, i.e., the 50 degree pitch of teeth 24 on strip 20 compared with the 80 degree pitch of teeth 32 on strip 22. Thus, the common acute angle of the front edges 34 forming the row of teeth on strip 22 is greater than the common acute angle of the front edges 26 forming the adjacent row of teeth on strip 20.

Insofar as the pitch or acute front angle of both teeth 24 and 32 making up the adjacent rows is concerned, this pitch or front angle can appropriately vary in the range of approximately 40 degrees to 90 degress under the teachings of this invention. However, maintaining a difference of more than 10 degress between the common acute angles or pitches of the two adjacent rows of teeth is desired to obtain the advantages in carding fiber webs achieved by this invention.

Although the teeth 24 and 32 have been illustrated with straight front and trailing edges, it is to be understood that all or a portion of the teeth may be curved. Likewise, all or a portion of the teeth may be made with a grooved bladed configuration if desired.

In utilizing the hereinabove described card clothing on carding elements employed in available carding machinery, a carded web can be obtained with the fibers therein disoriented or more tangled than one resulting from the utilization of prior art card clothing made up from toothed wire offering uniformly contoured teeth. Taking the example of a double wound toothed wire card clothing doffer cooperating in a carding machine with a single would conventionally toothed compacting roll, the double wound toothed wire roll is found to have the following effect. The wire with the heavy or strong pitch which would be exemplified by the pitch of teeth 24 on strip 20 facilitates the removal of the fibers from the carding cylinder by reason of the strong pitch of these teeth 24. Conversely, the teeth on the adjacent wire, strip 22 carrying teeth 32, with their slack pitch function to resist the removal of the fibers from the double wound doffer roll by the associated single wound compacting roll thus disorienting and tangling the fibers being handled by the carding machine. This makes for a web which is uniformly disoriented and acts to increase the cross directional strength of the web that is produced.

Basically, by using a double wound toothed wire roll made according to this invention as a doffer or compacting roll, the fibers of the web are uniformly disoriented giving a cross directional increase in the web strength. The different pitched teeth forming the card clothing is advantageous when used in a nonwoven operation where a more lofty and more uniform distribution of the fibers is obtained to give the web produced strength in all directions and not just predominately in only one direction which is the carding machine direction.

Aside from the above discussed examples where the invention can give advantageous results, it will be recognized by those knowledgeable in the fiber carding art that the metallic wire card clothing herein described and claimed may be used on any roll of a card or a similar machine to control the fibers and likewise be used in flats, plates, or covers to control the fibers being processed.

A preferred embodiment of the invention has been described herein utilizing specific terms. It will be understood that such description is for illustrative purposes only and is not to be considered as limited by the embodiment described. Many additional modifications and other embodiments may become apparent to those skilled in the art and it is to be understood that changes and variations may be made without departing from the spirit or scope of the following claims.

I claim:

1. Metallic wire card clothing for rolls and like carding elements comprising:

a plurality of generally flat wire strips disposed side-by-side on a supporting element;

an upstanding portion on each said strip providing a row of flat teeth extending longitudinally of each said strip with each tooth having front and trailing edges converging from the base portion of the strip to define a tooth point;

said front edges of the teeth in each said row defining a common acute angle with the axis of the strip on which they are located; and said common acute angle of said teeth front edges forming one row being greater than the common acute angle of said teeth front edges forming the adjacent row by a difference of more than 10 degrees.

2. Metallic wire card clothing as recited in claim 1 wherein said trailing edges of the teeth in each said row define a common back angle with the axis of the strip on which they are located with the back angles of adjacent rows being different.

3. Metallic wire card clothing as recited in claim 1 wherein said common acute angles have a difference of at least 20 degrees.

4. Metallic wire card clothing as recited in claim 1 or 3 wherein said common acute angles of said teeth front edges relative to the strip axis are in the range of approximately 40 degress to 90 degrees.

5. Metallic wire card clothing as recited in claim 1 or 3 wherein the points of said teeth in each row are of the same height relative to said strip axis.

6. Metallic wire card clothing as recited in claim 5 wherein said teeth are of the same height on said wire strips.

* * * * *